US010767871B2

(12) United States Patent
Budich

(10) Patent No.: US 10,767,871 B2
(45) Date of Patent: Sep. 8, 2020

(54) CLEANING DEVICE FOR COMMERCIAL COOKING DEVICES

(71) Applicant: BUDICH INTERNATIONAL GMBH, Hiddenhausen (DE)

(72) Inventor: Meinrad Budich, Hüllhorst (DE)

(73) Assignee: BUDICH INTERNATIONAL GMBH, Hiddenhausen (DE)

( * ) Notice: Subject to any disclaimer, the term of this patent is extended or adjusted under 35 U.S.C. 154(b) by 42 days.

(21) Appl. No.: 15/580,429

(22) PCT Filed: Jun. 1, 2016

(86) PCT No.: PCT/EP2016/062315
§ 371 (c)(1),
(2) Date: Dec. 7, 2017

(87) PCT Pub. No.: WO2016/198293
PCT Pub. Date: Dec. 15, 2016

(65) Prior Publication Data

US 2018/0163972 A1 Jun. 14, 2018

(30) Foreign Application Priority Data

Jun. 8, 2015 (DE) ..... 10 2015 109 019

(51) Int. Cl.
*F24C 14/00* (2006.01)

(52) U.S. Cl.
CPC ..... *F24C 14/005* (2013.01)

(58) Field of Classification Search
CPC ..... F24C 14/005
See application file for complete search history.

(56) References Cited

U.S. PATENT DOCUMENTS 3,815,625 A * 6/1974 Weise ..... F24C 15/2057 137/376
3,837,269 A * 9/1974 Sweet ..... B01D 45/08 126/299 E (Continued)

FOREIGN PATENT DOCUMENTS

DE 100 60 204 B4 4/2004
DE 102004004393 B3 5/2005

(Continued)

OTHER PUBLICATIONS

International Search Report issued in PCT/EP2016/062315; dated Sep. 30, 2016.

(Continued)

*Primary Examiner* — Benjamin L Osterhout
(74) *Attorney, Agent, or Firm* — Studebaker & Brackett PC

(57) ABSTRACT

The present invention relates to a cleaning device (200, 200') for commercial cooking devices (100, 100'). The cleaning device (200, 200') has a connection unit (2), in particular a connection piece (2), for accommodating a container (B, BR, BKI) with a solid cleaning agent (1R), a liquefaction device (2*a*, 2*b*) for liquefying the solid cleaning agent (1R), if necessary using a solvent, and optionally at least one first supply tank (12, 12R, 12K, 13R, 13K). In addition, the invention relates to a commercial cooking device (100, 100') and the use of a cleaning device (200, 200') according to the invention in commercial cooking devices (100, 100'). Finally, the present invention involves a method for cleaning commercial cooking devices (100, 100').

15 Claims, 4 Drawing Sheets

(56) References Cited

U.S. PATENT DOCUMENTS

| | | | | |
|---|---|---|---|---|
| 4,085,735 | A * | 4/1978 | Kaufman | B01D 47/06 126/299 E |
| 4,186,727 | A * | 2/1980 | Kaufman | B01D 47/06 126/299 D |
| 6,180,578 | B1 | 1/2001 | Hemm et al. | |
| 2006/0289450 | A1* | 12/2006 | Craghead | F24C 15/30 219/445.1 |
| 2007/0044789 | A1* | 3/2007 | Grieco | F24C 14/005 126/273 R |
| 2008/0078371 | A1* | 4/2008 | Boscaino | A21B 3/04 126/20 |
| 2008/0223357 | A1* | 9/2008 | Bartelick | B08B 9/00 126/21 A |
| 2009/0178579 | A1* | 7/2009 | Heiser | A47J 37/042 99/421 H |
| 2011/0011549 | A1* | 1/2011 | Pierce | D21J 3/10 162/227 |
| 2014/0299159 | A1* | 10/2014 | Helm | B05B 3/025 134/22.18 |
| 2015/0059807 | A1* | 3/2015 | Behle | B08B 9/08 134/22.1 |
| 2016/0341431 | A1 | 11/2016 | Topfer | |

FOREIGN PATENT DOCUMENTS

| | | | |
|---|---|---|---|
| DE | 10 2006 006 153 | A1 | 8/2007 |
| DE | 102007005503 | A1 | 7/2008 |
| DE | 102008039073 | A1 | 3/2010 |
| DE | 20 2010 013 989 | U1 | 2/2011 |
| DE | 10 2013 113 298 | A1 | 6/2015 |
| DE | 10 2013 021 732 | A1 | 7/2015 |
| DE | 10 2014 202 430 | A1 | 8/2015 |
| EP | 1209419 | A2 | 5/2002 |
| EP | 2 905 069 | A1 | 8/2015 |
| WO | 97/41203 | A1 | 11/1997 |
| WO | 2012/048680 | A1 | 4/2012 |
| WO | 2015/056063 | A1 | 4/2015 |
| WO | 2016/016351 | A1 | 2/2016 |

OTHER PUBLICATIONS

An Office Action mailed by the European Patent Office dated Apr. 4, 2019, which corresponds to European Patent Application No. 16726106.4-1009 and is related to U.S. Appl. No. 15/580,429.

* cited by examiner

CLEANING DEVICE FOR COMMERCIAL COOKING DEVICES

The present invention relates to a cleaning device for commercial cooking devices, as well as to a commercial cooking device with such a cleaning device. In addition, the invention relates to the use of a cleaning device according to the invention in commercial cooking devices. Finally, the present invention involves a method for cleaning commercial cooking devices.

A commercial cooking device is here understood as a device that usually has commercial uses, for example in canteen kitchens, culinary establishments and bakeries, outlets, etc., for thermally preparing (cooking) and/or heating foods. In particular, these include cooking appliances, grills, ovens, automatic ovens, steam cookers, combination steamers, microwave ovens or deep fryers. The cleaning device is used in particular for internally cleaning the commercial cooking device, above all its cooking chamber, in which the meals are usually prepared.

One special problem exists in particular for devices that operate with water and/or steam, for example steam cookers or combination steamers. As a rule, such devices have a line system with chambers, valves, pumps, etc., so as to supply water and/or steam to the cooking chamber or move the water and/or steam around in a circulating loop created by the line system. This line system cannot be accessed for manual cleaning, but still has to be kept hygienically clean. In general, high-alkaline cleaning agents are suitable for ensuring the necessary hygiene.

High-alkaline cleaning agents are today commercially available in a wide variety of presentation forms, for example as powders, granules, liquids, melting blocks or as pressed tablets. Powders, granules or liquids have proven effective for mechanically cleaning hard surfaces by hand, while pressed tablets or melted and then cooled block-shaped cleansers are used in addition to powders, granules or liquids for machine cleaning hard surfaces, e.g., machine cleaning dishes. The advantage to tablets and melting blocks over powders is that they can be accurately and easily dosed, do not make any dust, and are easy to handle. For example, these advantages can be used in household dishwashers or commercial dishwashers, wherein the high-alkaline cleaner is in both cases used for cleaning the machine itself (i.e., not while washing dishes). In commercial cooking devices as well, tablets have to date been manually placed in the cooking chamber, for example in proximity to a water/steam inlet (e.g., located in a fan propeller or present as a nozzle device in the cooking chamber), after which a cleaning program is started, during which water and/or steam are then supplied.

However, tablets and melting blocks were also found to have disadvantages. Breakage can arise precisely in tablets; naturally, tablets damaged in this way no longer offer the advantage of sufficient and accurate dosing. Another problem with tablets lies in the fact that the desired water solubility cannot always be ensured, i.e., tablets sometimes dissolve either too fast or too slow.

When using high-alkaline, corrosive cleaners in the conventional form as powders, tablets, granules or liquids, there is also the danger of the cleaner being spilled or sprayed, thereby coming into contact with the skin or eyes of the user. Therefore, the user at the very least must wear gloves and protective goggles when dosing such high-alkaline cleaners.

An object of the present invention is to provide a cleaning device, in particular for an alkaline cleaning agent, and a cleaning method for commercial cooking devices, which enables cleaning without the user intentionally or unintentionally coming into contact with the cleaning agent.

This object is achieved on the one hand by a cleaning device as well as a commercial cooking device, and a method for cleaning a commercial cooking device.

According to the invention, the cleaning device has a connection unit for accommodating a container with a preferably high-alkaline, solid cleaning agent and a liquefaction device for liquefying the solid cleaning agent. Liquefaction can here preferably take place using a solvent. Use can optionally be made of at least one first supply tank, in which the liquefied cleaning agent is initially stored, and then further liquefied as needed. This supply tank can also involve in particular a circulation container of a circulating loop. In a preferred embodiment, the connection unit is a connection piece.

Within the meaning of the invention, a solid cleaning agent is here understood as a cohesive, solid mass of solid cleaning agent (hereinafter also referred to as solid cleaning agent mass) in the container, such as a solid wax or a waxy composition like a gel, in particular a solid gel, or the like. Loose particle compositions or bulk material, like powders or granules, etc., are not included by the latter, for example. In a preferred composition, the solid cleaning agent is designed like a homogeneous, waxy mass with undissolved solids.

In a preferred embodiment, the solid cleaning agent has a pasty consistency, in particular a solid gel form. Within the meaning of the invention, "solid gel form" is here preferably understood to mean a firm and/or waxy gel, meaning that a cut made into the gel with a knife remains visible as a cut. For example, such a cleaning agent, in particular a gel, can be filled into a container in the liquid state, "harden" therein, and then achieve a solid consistency to form the solid cleaning agent (or cohesive solid cleaning agent mass). The container is here designed with the ability to permanently store and transport the solid cleaning agent. For example, it can here be a plastic bottle, a plastic tank or the like, preferably made out of HDPE (high density polyethylene).

Such gels are known as dishwashing detergents in prior art. For example, DE 3138425 A1 already described pasty cleaning agents for washing dishes based on silicate. The rheological behavior of the cleaners described therein is designed in such a way that a gel-like paste liquefies when subjected to mechanical forces, for example when shaken or pressurized on a deformable storage bottle or tube or with a dosing pump, and can be easily sprayed out of a nozzle. In like manner, DE 19 507 532 A1 discloses a corresponding aqueous, pasty cleaning agent for washing dishes based on sodium hydroxide. In principle, the composition of a solid cleaning agent for the invention can be designed in a manner similar to the mentioned publications if the required alkalinity is correspondingly set.

A solid cleaning agent used according to the invention can also not run out of an open container when in an "overhead" position. The cleaning device according to the invention with the liquefaction device can be used to initially dissolve the alkaline solid cleaning agent directly out of the container, i.e., directly in the container, and then liquefy it without a manual dosing being required for this purpose. In other words, the user can dock the container with the solid cleaning agent mass to the connection unit as delivered. This advantageously avoids contact with the solid cleaning agent and the danger associated herewith. Use does not require any additional protection, such as gloves or protective goggles. In like manner, the solid cleaning agent does not have to be covered with a sealing layer in the container, so as to prevent the solid cleaning agent from being able to inadvertently get out of the container prematurely.

These advantages are achieved in particular through the inventive use of a solid cleaning agent (or solid cleaning agent mass) arranged in a container, in particular when this solid cleaning agent is used in the mentioned cleaning device according to the invention.

There are various ways of realizing the liquefaction device so as to dissolve the solid cleaning agent directly in the container itself, and those will be explained in greater detail later. A solvent potentially to be used here within the meaning of the invention can thereby serve to liquefy the solid cleaning agent or support liquefaction. Provided only a slight amount of solvent is used for liquefaction if any, the cleaning agent liquefied in this way can initially form a cleaning concentrate, which can preferably be further liquefied as needed later on. In a preferred embodiment, the solid cleaning agent can initially be liquefied via the liquefaction device, and be further liquefied at a later point in time, for example after transferred into a supply tank, in particular a circulation container, with the addition of solvent, preferably fresh water.

In addition, an object of the present invention relates to a commercial cooking device, preferably a commercial cooking appliance, a grill, an oven, an automatic oven, a steam cooker, a combination steamer, a microwave oven or a deep fryer, which has such a cleaning device according to the invention.

The cleaning device according to the invention can here be integrated completely or at least partially into the commercial cooking device. One example for a "partial" integration involves connecting an external dosing device of the cleaning device to the actual cooking device, which then has the additional components of the cleaning device, for example, such as a line system, the circulation container, pumps, etc., so as to introduce the cleaning agent into the cooking chamber. A complete integration is when all components, including the connection unit or connection piece for the container with the solid cleaning agent mass, have been integrated into the cooking device or its housing.

A cleaning device according to the invention can in particular have a controller, in order to actuate all components of the cleaning device, so that the cooking device, preferably its cooking chamber and in particular the line system, can be cleaned according to the cleaning method explained below. This control device can also be part of an overall control device of the cooking device, which also controls the further operation of the cooking device when preparing the meals. In particular, such an overall controller of the cooking device can also be used for cleaning according to the invention by modifying the overall controller in a suitable manner. This is at least partially also possible by correspondingly adjusting the firmware of a controller, if the overall controller has a corresponding processor unit, for example a microprocessor or the like, which is equipped with firmware.

In like manner, the cleaning device according to the invention as a line system, preferably also as a line system for moving the liquefied cleaning agent into the cooking chamber, can also use a line system of a circulating loop of the cooking device that is present anyway, and usually used for transporting or circulating water and/or steam and/or supplying fresh water. The advantage to this is that this water or steam line system is inevitably also cleaned. The line system will in the following still be regarded as part of the cleaning device according to the invention.

In a method according to the invention for cleaning a commercial cooking device, at least the following steps are performed:

(i) Placing a container with a solid cleaning agent, in particular a solid gel, into a connection unit;

(ii) Liquefying the solid cleaning agent in the container by means of a liquefaction device, optionally while adding solvent, to generate a liquefied cleaning agent;

(iii) Optionally transferring the liquefied cleaning agent into a supply tank, wherein the liquefied cleaning agent can be further liquefied, potentially while adding more solvent, in particular while adding fresh water, and (iv) Transferring the liquid cleaning agent, preferably via nozzles, into a cooking chamber of the commercial cooking device.

The device according to the invention or the method according to the invention enables individual or multiple doses of a solid cleaning agent without any danger of the cleaner being spilled or sprayed, and thus coming into contact with the skin or eyes of the user, even without a sealing layer on the solid cleaning agent.

An individual dose is here understood as a single dose of the liquefied cleaning agent, wherein the content of the container is consumed in a single cleaning process. In other words, each time the device is cleaned, a new container is introduced into the connection unit, which contains the quantity of solid cleaning agent required for a cleaning process.

By contrast, a multiple dose is understood within the meaning of the present invention as an at least twofold dose of the cleaning agent. In this embodiment, the entire contents of solid cleaning agent is removed from the container during liquefaction and emptied once into the supply tank, from which respective partial quantities are removed. Alternatively, a corresponding partial quantity of the solid cleaning agent can be removed from the container and emptied into a supply tank.

Of course, the method according to the invention yields an optimal cleaning efficiency. The specific concentration of cleaning agent here depends on the desired application, and is familiar to the expert.

Additional especially advantageous embodiments and further developments of the invention may be derived from the following description, wherein features from different exemplary embodiments can be combined into new exemplary embodiments.

As mentioned above, the liquefaction device of the cleaning device can be configured in varying ways.

In a preferred variant, the liquefaction device has a heating device, which is preferably designed in such a way that the container is heated in the connection unit, in particular of a connection piece. In particular, such a heating device can be designed in such a way as to be operated electrically and/or with warm water and/or condensing steam, etc. Heating the solid cleaning agent with a heating device advantageously causes the solid cleaner to melt. The alkaline solid cleaning agent can be set in such a way as to melt at an elevated temperature and can run out of the container. The solid cleaning agent preferably melts at a temperature of above 40° C., especially preferably at a temperature of at least 50° C., in particular at a temperature of at least 60° C. Under conventional storage conditions, a solid cleaning agent designed in this way does not melt even when stored under elevated temperature conditions, for example in the summer or in warmer climate zones.

In principle, the heating device could be arranged only on a narrower ring, for example on the container opening or on the bottle head. However, when thermally emptying the container, the entire bottle is advantageously heated to ensure complete emptying. To this end, special preference goes to a heated tubular receiving bush, into which the entire bottle is inserted.

The material of the connection unit, in particular of a connection piece with heating device, is preferably selected in such a way as to have good thermal conductivity. A preferred coefficient of thermal conductivity ($\lambda$) here lies within a range of 10 to 450 W/(m K), for example, preferably within a range of 15 to 400 W/(m·K), in particular within a range of 20 to 300 W/(m·K). Use can preferably be made of metals, in particular copper, and possibly also heat-conducting pastes or the like.

Alternatively or additionally, the liquefaction device can be equipped with a rinsing nozzle, i.e., alternatively or additionally to using a temperature increase for melting purposes, the alkaline solid cleaning agent can be dissolved out of the container by the solubility of an inflowing solvent, in particular a water jet and/or steam. The solution equilibrium is preferably selected in such a way that already adding a slight quantity of water again leads to a quasi-liquid, low-viscosity consistency of the cleaning agent.

As mentioned, a potentially used solvent for liquefying the solid cleaning agent can preferably consist simply of fresh water. In an alternative composition, the solvent can contain protic and/or aprotic solvents, preferably organic solvents, such as hexane and/or heptane and/or alcohols, in particular methanol, ethanol and propanol. Of course, a solvent within the meaning of the invention is suitable for application in commercial cooking devices.

The liquefied cleaning agent obtained in this way can preferably be transferred completely into a supply tank, if necessary directly into a circulation container of the circulating loop. A solvent feed to the supply tank can then be used by the liquefied cleaning agent, preferably in conjunction with a defined quantity of additional solvent, especially preferably fresh water, to form a concentrated solution, which has a sufficient alkalinity for several cleaning processes (multiple dosing) or for a single cleaning process (individual dosing). The cleaning device then not only effects a successive dilution with water in the solid cleaning agent. Rather, such a supply here takes place in a controlled fashion, so as to ensure the desired concentration of cleaning agent at any one time.

In principle, however, the liquefied cleaning agent could also be introduced into the cooking chamber of the commercial cooking device immediately after the liquefaction process without adding any more solvent. The ready-to-use cleaning solution can be diluted more or less strongly depending on the degree of contamination. However, when supplying a concentrated cleaning solution, a preferred dilution with solvent lies within a range of 2:1 to 1:2, especially preferably within a range of 1.5:1 to 1:1.5, especially within a range of 1:1. For example, if the gel has a water content of approx. 35% w/w, and the stable, concentrated cleaning solution is to have a water content of roughly 70% w/w, the dilution with water is 1 to 1.

In a preferred embodiment, the alkaline solid cleaning agent is essentially emptied from the container. "Essentially" is here understood as the solid cleaning agent being emptied from the container or cleaner bottle in a percentage of at least 90% w/w, preferably in a percentage of at least 95% w/w, and especially preferably in a percentage of at least 99% w/w.

Exposure to steam is also an especially well-suited way for essentially emptying the container with the solid cleaning agent, in particular the waxy or solid gel, since the latter can get to the entire interior surface of the container just by virtue of its physical consistency.

As steam condenses on the interior surfaces of the container, heat is transmitted, and the concentration equilibrium also shifts to a higher water concentration. In other words, heat and solvent are here directly combined and used in the form of a heated solvent, specifically preferably steam. As a result of both, any residual solid cleaning agent, in particular solid gel, on the surfaces thins, and runs out of the container.

When spraying solvent, in particular water, this can also be achieved by correspondingly configuring and adjusting the spraying device in such a way that the entire interior surface of the container is exposed to water.

However, the solid cleaning agent, in particular the waxy or solid gel, can also be dissolved already by the normal humidity. If the container remains hooked up to the connection unit over a prolonged period of use, and is only changed out after several days or even weeks, the solubility imparted by humidity can be sufficient for the container to subsequently be completely clean, and dripping alkaline solution to not pose any danger of corrosion. To this end, a preferred solid cleaning agent, in particular a waxy or solid gel, is designed in such a way that a slight quantity of water is already enough to liquefy the gel. The solution equilibrium of the components here preferably is close to the solidification point of such a solid cleaning agent.

In order to ensure a tight connection between the container incorporating the solid cleaning agent and the connection unit, the connection unit preferably has a receiving bush, preferably with a screw-driving or connecting device, in which the container can be easily and reliably secured.

After the solid cleaning agent has been liquefied, the resultantly obtained liquefied cleaning concentrate or cleaning agent can advantageously be quickly, easily and precisely transferred or dosed, does not make any dust, and can be fabricated with limited technical effort out of the solid cleaning agent, in particular the solid gel.

In order to be able to readily dissolve the solid cleaning agent with a solvent, preferably water, especially preferred components of the solid cleaning agent, in particular of the solid or waxy gel, have a good water solubility.

Furthermore, the solid cleaning agent can be used in combination with other agents, without as a result losing its inventive variable consistency or strength, and its advantageous water solubility. In order to set a desired viscosity, the solid cleaning agents can thus contain glycols, glycol derivatives and/or certain alkanolamines, for example. The viscosity can also be set using the water content of the solid cleaning agent. A preferred water content of the solid cleaning agent here lies within a range of 5% w/w to 45% w/w, preferably within a range of 10% w/w to 40% w/w, in particular within a range of 15 to 35% w/w.

The alkaline properties of the solid cleaning agent can also be influenced by its content of alkaline components. In particular, the solid cleaning agent contains an alkali lye, preferably potash and soda lye, especially preferably soda lye. In particular, the advantage to a solid gel over a liquid alkaline cleaner is that the alkalis necessary for the cleaning process can be more highly concentrated. Therefore, a preferred content of NaOH in the solid cleaning agent lies within a range of 15 to 45% w/w, especially preferably within a range of 20 to 40% w/w, in particular within a range of 25 to 35% w/w. In an embodiment, the solid cleaning agent or the preferred waxy gel thus has a pH value of above 11, especially preferably a pH value of above 12, and in particular a pH value of above 13.

In addition, a preferred solid cleaning agent contains surfactants and/or paraffin oil and/or polyhydroxy compounds preferably with glycerin, glucose, glyoxal or propylene glycol as the carrier phase for other ingredients common in cleaners.

The surfactants used can be both anionic surfactants and cationic surfactants, amphoteric surfactants and nonionic surfactants. Anionic and/or nonionic surfactants are preferred surfactants for the solid cleaning agent. The cleaning performance is significantly influenced by the quantity of surfactant. However, the hardening duration of the solid cleaning agent after all components have been added also depends in particular on its concentration.

In particular, the solid cleaning agent can additionally contain a builder substance in a quantity of up to 60% w/w, preferably 15 to 40% w/w. The builder substance preferably has a high water solubility. Possible builder substances include alkali phosphates, which can be present in the form of their sodium or potassium salts. Examples thereof include: tetrasodium diphosphate, pentasodium triphosphate, so-called sodium hexametaphosphate along with the corresponding potassium salts or mixtures of sodium and potassium salts. Further to be mentioned are complexing agents, e.g., nitriolotriacetate or ethylenediaminetetraacetate. Builder substances also include soda and borax within the framework of the present invention. A preferred builder substance of the solid cleaning agent is methylglycinediacetic acid (MGDA), for example which is available from BASF under the name Trilon® M.

Additional possible water-soluble builder components include organic polymers of a native or synthetic origin, above all polycarboxylates. For example, these can be polyacrylic acids and copolymers of maleic acid anhydride and acrylic acid, as well as the sodium salts of these polymeric acids. Commercially available products include Sokalan® CP 5 and PA 50 from BASF, and Alcosperse® 175 from Akzonobel. For example, suitable native polymers can be oxidized starch (e.g., DE 42 28 786) and polyamino acids like polyglutamic acid or poly aspartic acid, for example from Cygnus, Bayer and Rohm & Haas.

Also possible as builder components are naturally occurring hydroxycarboxylic acids, e.g., mono, dihydroxy-succinic acid, α-hydroxypropionic acid, citric acid, gluconic acid, as well as salts thereof. Polyepoxysuccinic acid (PESA) is a preferred hydroxycarboxylic acid as a builder component for the solid cleaning agent. Citrates are preferably used in the form of trisodium citrate dihydrate.

Other builder substances are amorphous metasilicates or sheet silicates. Crystalline sheet silicates are also suitable builders, provided they are sufficiently alkali stable.

Especially preferred builder substances are selected from the group of pentasodium triphosphate, trisodium citrate, nitrilotriacetate, ethylene diamine tetraacetate, soda, alkali silicate or mixtures thereof.

The solid cleaning agent is preferably composed in such a way that the liquefied cleaning agent can be mixed, with the associated advantages already being present at room temperature.

The cleaning device preferably has a number of pumps, so as to transport the liquefied cleaning agent. As mentioned, the cleaning device has a line system, in particular for creating a circulating loop, which in particular can include the pump(s), so as to convey the liquefied cleaning agent into the cooking chamber. A trace heater is especially preferably also provided on the line system and/or on a circulation container, for example a conventional flow heater or a heat exchanger, so as to heat up the cleaning agent. Alternatively, steam can also be blown into the diluted cleaning agent (i.e., the cleaning solution).

During individual dosing, the liquefied solid cleaning agent can get directly out of the container and into a circulation container of the line system or circulating loop, and there potentially be mixed with the necessary quantity of solvent, in particular water, so as to set the alkalinity required for a cleaning process in the diluted cleaning agent.

In a preferred embodiment, the cleaning device according to the invention allows for multiple dosing, as mentioned above, i.e., at least a twofold dosing, of a cleaning concentrate or cleaning agent.

The liquefied cleaning agent is here preferably initially transferred into a first supply tank as a cleaning concentrate, and temporarily stored there until the time it is used. Additional solvent can optionally be supplied, in particular fresh water. To prepare a ready cleaning solution for a specific cleaning process, a portion or defined quantity of the cleaning concentrate can be transferred or dosed into another supply tank, e.g., a circulation container of the circulating loop of the cooking device, preferably via a dosing pump.

Depending on the volume of the prepared cleaning concentrate or number of desired doses, a cleaning process can in this way be performed as needed, i.e., the dosed quantity of liquid cleaning agent can then be introduced into the circulating loop or cooking chamber. However, even in this additional supply tank or circulation container, the cleaning agent can be further liquefied or diluted with the addition of fresh water or some other solvent.

The advantage to this multiple dosing is that the solid cleaning agent from the container only has to be liquefied once, with repeated cleaning of the commercial cooking device then being possible without having to secure a respectively new container for this purpose.

The first supply tank and/or the additional supply tank, in particular the circulation container, can preferably contain a mixing device, preferably an agitator unit, for better dissolving and mixing the liquefied cleaning concentrate or cleaning agent. In an especially preferred embodiment, once the liquefied cleaning agent has been transferred into a supply tank, mixing continues at room temperature for at least another 1 to 5 minutes, preferably for 3 minutes. According to the invention, this makes it possible to achieve an optimal homogeneity for the cleaning agent, which in general can only be realized with difficulty with solid cleaners. Because the liquefied cleaning agent can be mixed, even temperature-labile constituents undergo no change, thereby continuing to ensure an optimal cleaning efficiency of the cleaning agent. If the cleaning concentrate or cleaning agent contains temperature-labile components, the provided supply tank can optionally be cooled.

In order to determine an optimal homogeneity of the dissolved or diluted cleaning agent, specific sensors can be integrated into the cleaning device, in particular into the supply tank, which trigger an agitation interval given an inadequate homogeneity of the cleaning concentrate or cleaning agent. Even after a prolonged storage of the cleaning agent, this makes it possible to prevent potentially present higher density substances from settling, as a result of which the cleaning agent would be limited in its cleaning efficiency or even overdosed.

In particular when temporarily storing the cleaning concentrate or cleaning agent in a supply tank and optionally in another supply tank or circulation container of the cleaning device, the evaporation of liquid constituents of the cleaning concentrate or cleaning agent can be countered by applying an overpressure, thus always guaranteeing a defined concentration of the cleaning agent.

As mentioned, the cleaning solution can be repeatedly circulated or pumped during the cleaning process. For example, the expended cleaning solution can drain through an outlet opening in the cooking chamber, as a rule an outlet sieve on the floor of the cooking chamber, and be relayed back into the circulation container or directly back to the nozzles by means of a pump. After the cooking chamber has been cleaned, the expended cleaning solution can drain through the outlet opening in the cooking chamber and then be removed by means of a pump and disposed of. To this end, an outlet valve can preferably be provided, so as to switch between a return to the cleaning process or a removal of the expended cleaning solution.

Once the cleaning process has ended, i.e., after the cooking chamber has been cleaned with the liquefied cleaning agent and the expended cleaning agent has been removed, either rinsing with fresh water can take place, and/or another rinsing process can optionally be performed, in particular a rinsing cycle with a rinsing agent.

In a preferred embodiment, the cleaning device according to the invention can thus have an additional connection unit for accommodating an additional container, and optionally also an additional liquefaction device allocated to this connection unit. In particular, the additional container can contain a rinsing agent.

The composition of such a rinsing agent can also consist of a solid, similarly to the solid cleaning agent. However, the rinsing agent can preferably be present as a liquid or in the form of a powder or granules. In general, such rinsing agents are known, and can be used within the meaning of the present invention. A preferred composition of a rinsing agent contains one or more acids and a surfactant, especially preferably a nonionic surfactant, in particular a low-foam, nonionic surfactant.

In a preferred embodiment, a sealing layer is located at the outlet of the container with a rinsing agent, e.g., in a bottle neck or the like, which prevents the rinsing agent from exiting the container in an "overhead" position. Such a sealing layer can preferably be a firm or waxy layer, in particular a gel, or a film in the cover. The sealing layer can also comprise a first phase of the rinsing agent.

The sealing layer can have a variable melting temperature. In this embodiment as well, the connection unit can be heated with a heating device or be equipped with a rinsing nozzle for dissolving the sealing layer and/or liquefying a solid rinsing agent. Therefore, the rinsing agent can advantageously also essentially be emptied from its container by increasing the temperature and/or rinsing with the rinsing nozzle, which ensures an efficient rinsing process.

A preferred melting temperature of the rinsing agent and/or sealing layer here lies in a range above the melting temperature of the solid cleaning agent. As an advantageous result, the solid rinsing agent is only emptied after heated to a defined temperature. The solid rinsing agent or sealing layer advantageously melt at a temperature of above 70° C., preferably at a temperature of above 75° C., in particular at a temperature of above 80° C.

If the container with the rinsing agent is actively heated separately, and heating the solid cleaning agent does not affect the sealing layer, the melting temperature of the sealing layer can also be lower.

The rinsing agent can subsequently also be transferred into an optionally provided supply tank, possibly liquefied further while supplying solvent, and if needed be transported by means of a pump into an optional additional supply container, in particular a circulation container, in the cooking chamber.

Of course, the expert can in part vary the sequence of the aforementioned procedural steps depending on the application or requirements thereof.

In an alternative embodiment, the container can be designed as a combination container, with a cleaning agent compartment for the solid cleaning agent according to the invention described above (or the solid cleaning agent mass) and a separate rinsing agent compartment for a rinsing agent.

The combination container here preferably has parallel arranged compartments or separate, parallel chambers each preferably with separate outlet openings. Parallel arranged compartments are here understood as a partial area of a container, for example a bottle, which has a separate opening area toward the outside of the container, so that it would in principle be possible to remove the contents of both compartments simultaneously, i.e., in parallel.

For example, this can be realized by dividing the interior of the container into two partial areas by means of a separation unit, e.g., a partition made out of plastic or the like. Such a separation unit inside of the container can run parallel to the outer side walls of the combination container, for example. In a preferred alternative, two partial containers, i.e., two bottle parts, for example, can also be connected with each other in some way, e.g., via the mechanical form closure (for example, via a plug and/or tongue-and-groove connection and/or dovetail connection) and/or adhesive bonding and/or welding of the partial containers, so as to yield the compartments of a combination container. In another preferred alternative, a container, preferably with two outlet openings or necks, is blown in such a way as to yield two closed chambers with a central web, which separates the chambers or compartments from each other, wherein in particular a separate outlet opening can be allocated to each chamber.

A front end of a combination container has at least one outlet opening for the liquefied cleaning agent or rinsing agent. This can involve a shared outlet opening for both parallel compartments. Such an outlet opening can then be divided into two outlet areas by a separation unit or partition, for example. As mentioned, however, the container preferably has a separate outlet opening for the compartments. Such a combination container preferably also has a solid cleaning agent, which in particular is designed as a waxy or firm gel. All other components and parameters of the solid cleaning agent can also be designed as described above.

When using a container designed as a combination container, the solid cleaning agent is also first dissolved out of the cleaning agent compartment in an additional cleaning cycle. In an additional rinsing cycle, the rinsing agent is removed from the rinsing agent compartment. The rinsing agent can here also be present in the compartment provided for this purpose in the form of a solid, in particular in the form of a solid or waxy gel, and/or be covered with a sealing layer.

In order to prevent corrosion by a high-alkaline solid cleaning agent or from the optional use of a rinsing agent, a preferred material for the commercial cooking device is a high-alloy, stainless, semi-stainless or corrosion-resistant steel or stainless high-grade steel. Such materials preferably have a percentage of chromium exceeding 10%, and are known in prior art by the trade names Cromargan (WMF), Nirosta (Outokompu Nirosta), Remanit (Witten-Krefeld high-grade steel), or by the designation VA-steel, V2A-steel, V4A-steel, V1A-steel, V3A-steel, V5A-steel or also inox.

Use can also be made of alternative corrosion-resistant alloys, such as chromium-nickel alloys, which contain less than 50% iron. In particular, the cooking chamber of the commercial cooking device is advantageously configured using a material that results in easy to clean surfaces, so as to enable a good cleaning hygiene for the commercial cooking device. Antibacterial material can here also be used.

The invention will be explained in more detail once again with reference to the attached figures based on exemplary embodiments. The same components are here provided with identical reference numbers on the various figures. As a rule, the figures are not to scale. Shown on:

Figure 1:
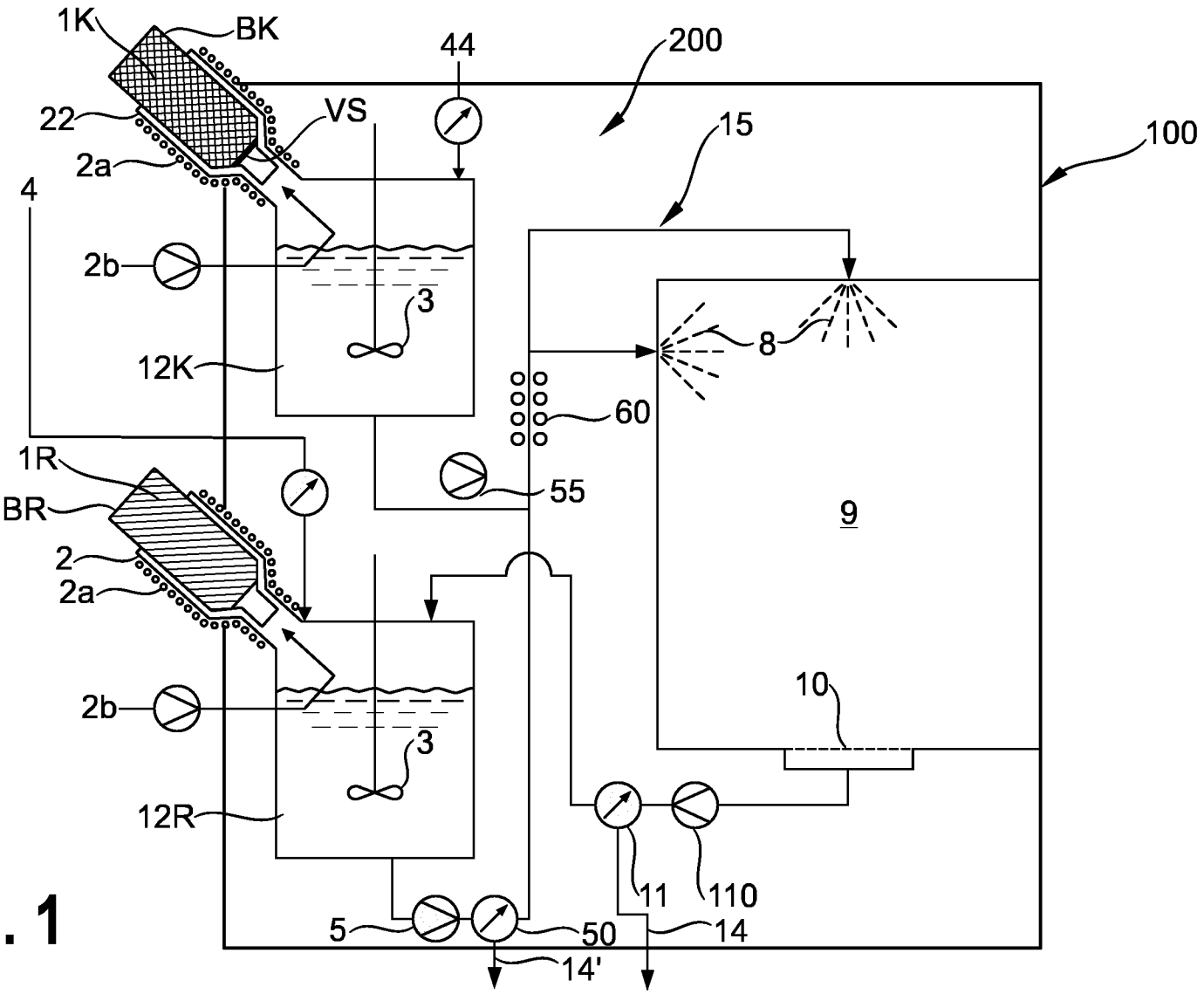
FIG. 1 is a schematic view of a first exemplary embodiment of a commercial cooking device with an integrated cleaning device.

The figures each show a cooking device 100, 100', here a commercial combination steamer, with a cooking chamber 9, in which the product to be heated, in particular cooked, or the meals are introduced during operation through a door (not depicted).

The cooking chamber 9 usually also contains (possibly removable) built-in components, such as rail systems, brackets or the like, so as to hold baking trays, casserole pans, etc. having a matching design. To improve clarity, these built-in components are not shown here.

A line system 15 can be used to expose the cooking chamber 9 to water, generate steam in the cooking chamber 9 or expose it directly to steam. Both the cooking chamber itself, with or without built-in components, and the line systems for the water or steam must be regularly cleaned. For this purpose, the cooking devices 100, 100' each have a cleaning device 200, 200'.

The figures each only show the components essential for the cleaning device 200, 200' according to the invention. Such a combination steamer clearly can have all other conventional components, such as fans, heating devices for the walls of the cooking chamber, overhead grills, steam generators, along with a suitable controller to control the entire device in use while preparing the meals, but also when cleaning with the cleaning device 200, 200' according to the invention.

FIG. 1 shows a first exemplary embodiment with a cleaning device 200 completely integrated into the cooking device 100. It can be used for the individual or multiple dosing of a solid cleaning agent 1R, as well as for the individual or multiple dosing of a rinsing agent 1K.

The cleaning device 200 here has a connection unit 2 in the form of a connection piece 2 for accommodating a container BR, here a bottle BR, with an alkaline solid cleaning agent 1R, a liquefaction device 2*a*, 2*b*, a supply tank 12R for a cleaning solution, which is here the circulation container 12R of a circulating loop of the cooking device 100, and a fresh water supply 4.

The bottle BR with the alkaline solid cleaner 1R, here in the form of a solid gel as described above, is here docked in an "overhead" position in the connection piece 2 in such a way as to create a largely tight connection, from which the alkaline solid cleaner 1R cannot laterally exit. Prior to placement in the connection piece 2, a usually present cover is removed from the bottle BR.

The liquefaction device for liquefying the alkaline solid cleaner 1R in the bottle BR here has a heating device 2*a* around the connection piece 2, with which the container BR along with the solid cleaning agent 1R can be heated. In particular, such a heating device 2*a* can be electrical, designed for warm water or condensing steam. In addition, the liquefaction device is here equipped with a rinsing nozzle 2*b*, so as to expose the solid cleaning agent 1R (alternatively or additionally to heating the solid cleaning agent 1R) to a jet of solvent through the bottle neck (without loss of generality, it is assumed below that the solvent is water and/or steam), which dissolves the solid cleaning agent 1R.

The connection piece 2 is here arranged at an upper end of the supply tank 12R or circulation container 12R, so that the liquefied cleaning agent 1R is moved out of the container BR and into the supply tank 12R by gravity as a kind of "cleaning concentrate".

Furthermore, a fresh water supply 4 can be used to feed additional fresh water into the supply tank 12R to further dilute the liquefied cleaning agent 1R. In order to better dissolve and mix the liquefied cleaning concentrate or cleaning agent for obtaining a cleaning solution with the desired concentration or alkalinity, the supply tank 12R has a mixing device 3, here an agitator unit 3. In order to clean the cooking chamber and line system, a pump 5 can be used to introduce the cleaning solution provided in the supply tank 12R into the cooking chamber 9 through the line system 15 and via inlet openings 8, in particular nozzles 8.

An (optional) trace heater 60 (here a flow heater) is here additionally arranged on the line system 15, and can be used to set the cleaning solution to a desired temperature.

While and after cleaning the cooking chamber 9, the expended cleaning solution can drain out of the cooking chamber 9 through an outlet opening 10 (the conventional outlet sieve) arranged in the floor of the cooking chamber 9, and can continue to be pumped thereafter by means of a pump 110. An outlet valve 11 setting can be adjusted to determine whether the cleaning solution coming out of the cooking chamber 8 is to be pumped back into the supply tank 12R or circulation container 12R for another pass, or removed through an outlet line 14 and properly disposed of. Additionally or alternatively, the cleaning solution can also be pumped out of the circulation container 12R via the pump 5, an outlet valve 50 and an outlet line 14'. Once the cleaning process has ended, rinsing can optionally take place with fresh water.

As illustrated on FIG. 1, the cleaning device 200 according to the invention integrated into the commercial cooking device 100 can also have a second connection piece 22 for accommodating a container BK, in particular a bottle BK, with rinsing agent 1K. Just as for the solid cleaning agent 1R, the connection piece 22 can in this case as well be heated with a heating device 22*a* arranged thereon and/or be equipped with a rinsing nozzle 22*b*. In a manner similar as for the solid cleaning agent 1R, the rinsing agent 1K can also essentially be emptied from its container BK, thereby ensuring a complete utilization, and thus an efficient rinsing process.

In the case at hand, the rinsing agent 1K is a powder, a granule or a liquid. The outlet opening of the bottle BK is provided with a sealing layer VS, preferably in the form of a film or in the form of a gel/wax plug. The sealing layer VS can preferably be dissolved through a temperature increase and/or exposure to water or steam, with gravity moving the rinsing agent 1K into a supply tank 12K, at whose upper end the connection piece 22 is here arranged. The sealing layer can preferably also be secured in a cover (not depicted) of the bottle BK, so that the user only has to remove a cover layer, and the bottle can then be placed on the connection piece 22.

The rinsing agent 1K is subsequently further liquefied in the supply tank 12K, possibly while supplying fresh water via a fresh water supply 44 and using an agitator unit 3. In the rinsing process, a pump 55 then introduces the rinsing agent into the cooking chamber 9 as needed via the line system 15 and via the nozzles 8. After the rinsing process is over, the expended rinsing agent is disposed of by way of the outlet opening 10 and pump 110, valve 11 and outlet line 14. Given a correspondingly configured line system, it would here also be possible to initially return the rinsing agent from the cooking chamber 9 into the supply tank 12K of the rinsing agent for another pass, i.e., the supply tank 12K then serves as a circulation container for the rinsing cycle (not shown).

In a simplified alternative (also not shown), the cleaning device 200 only comprises the lower part depicted on FIG. 1 with the connection piece 2 for the solid cleaning agent 1R.

In this variant, the bottles preferably contain portions for a cleaning process or rinsing process (individual dose).

Figure 2:
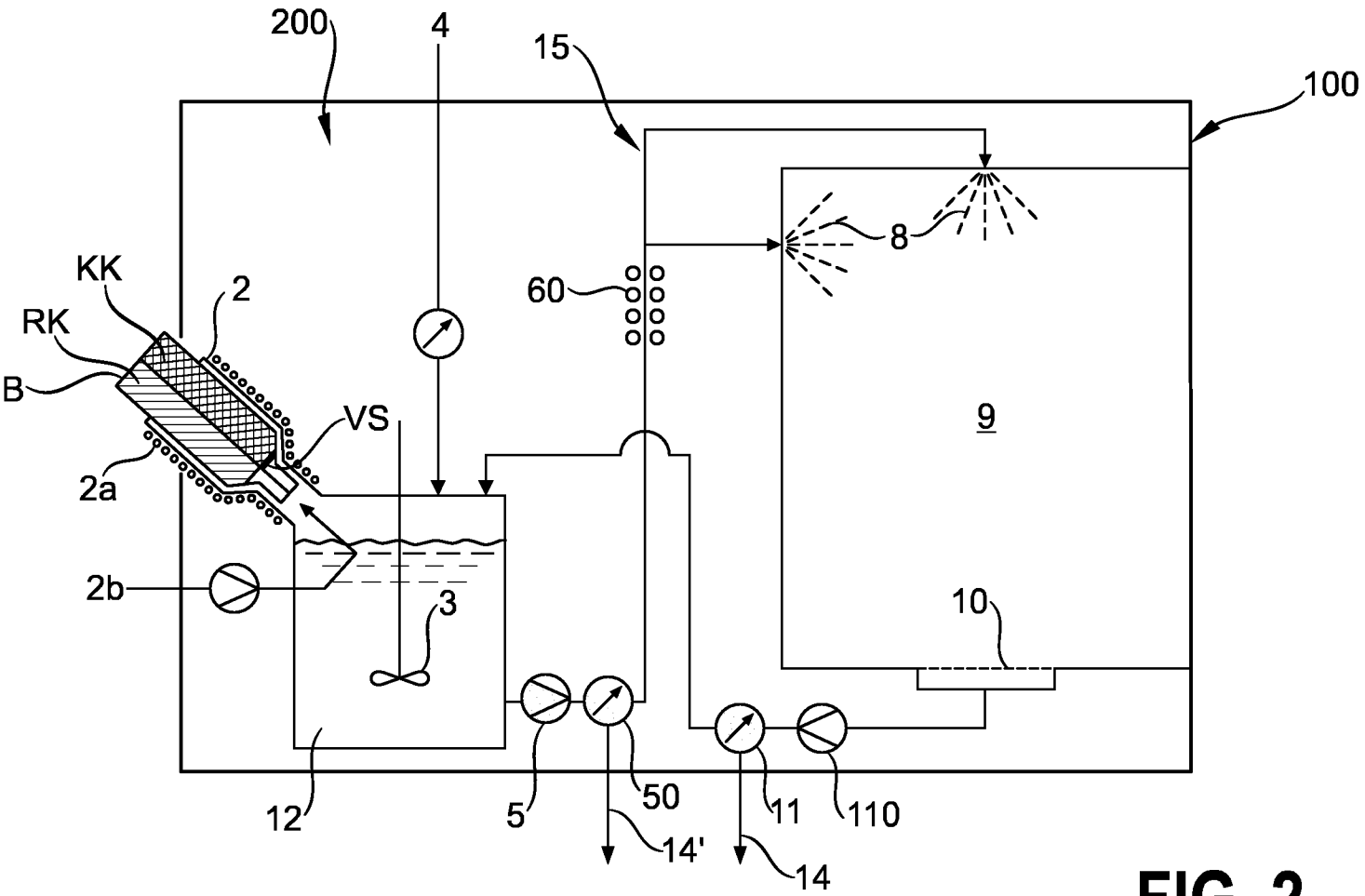
FIG. 2 is a schematic view of a second exemplary embodiment of a commercial cooking device with an integrated cleaning device.

In an alternative embodiment shown on FIG. 2, the cleaning device 200 according to the invention integrated into the commercial cooking device 100 only has one connection piece 2 for a combination bottle B. This bottle B has both a cleaning agent compartment RK or cleaning agent chamber with a solid cleaning agent 1R and a rinsing agent compartment KK or rinsing agent chamber with a rinsing agent 1K for individual dosing. In this bottle B, the outlet opening of the rinsing agent compartment KK is provided with a sealing layer VS in the form of a film or a gel/wax plug or the like (not shown). The combination bottle B is here only illustrated schematically. In practical execution, the bottle can preferably be designed as a dual chamber bottle with two chambers or partial bottles and separate neck openings, as described above. In this case, the connection piece 2 is correspondingly adjusted to the dual chamber bottle.

The solid cleaning agent 1R in the container B is here also initially liquefied in the connection piece 2 by means of the liquefaction device 2*a*, 2*b*, essentially transferred into the supply tank 12 or circulation container 12, and introduced into the cooking chamber 9 through nozzles 8 by means of a pump 5.

Once the cleaning process is complete and the expended cleaning agent has been removed, the rinsing agent 1K is released in a second step by dissolving the sealing layer VS, i.e., the film or the like, by increasing the temperature and/or using rinsing nozzles, and essentially transferred into the supply tank 12 or circulation container 12. The rinsing agent is hereafter also introduced into the cooking chamber 9 of the commercial cooking device by means of the pump 5. After the rinsing process is over, the expended rinsing agent is again removed via the outlet opening 10. Upon completion of the cleaning and/or rinsing process, rinsing can optionally take place with fresh water here as well.

Figure 3:
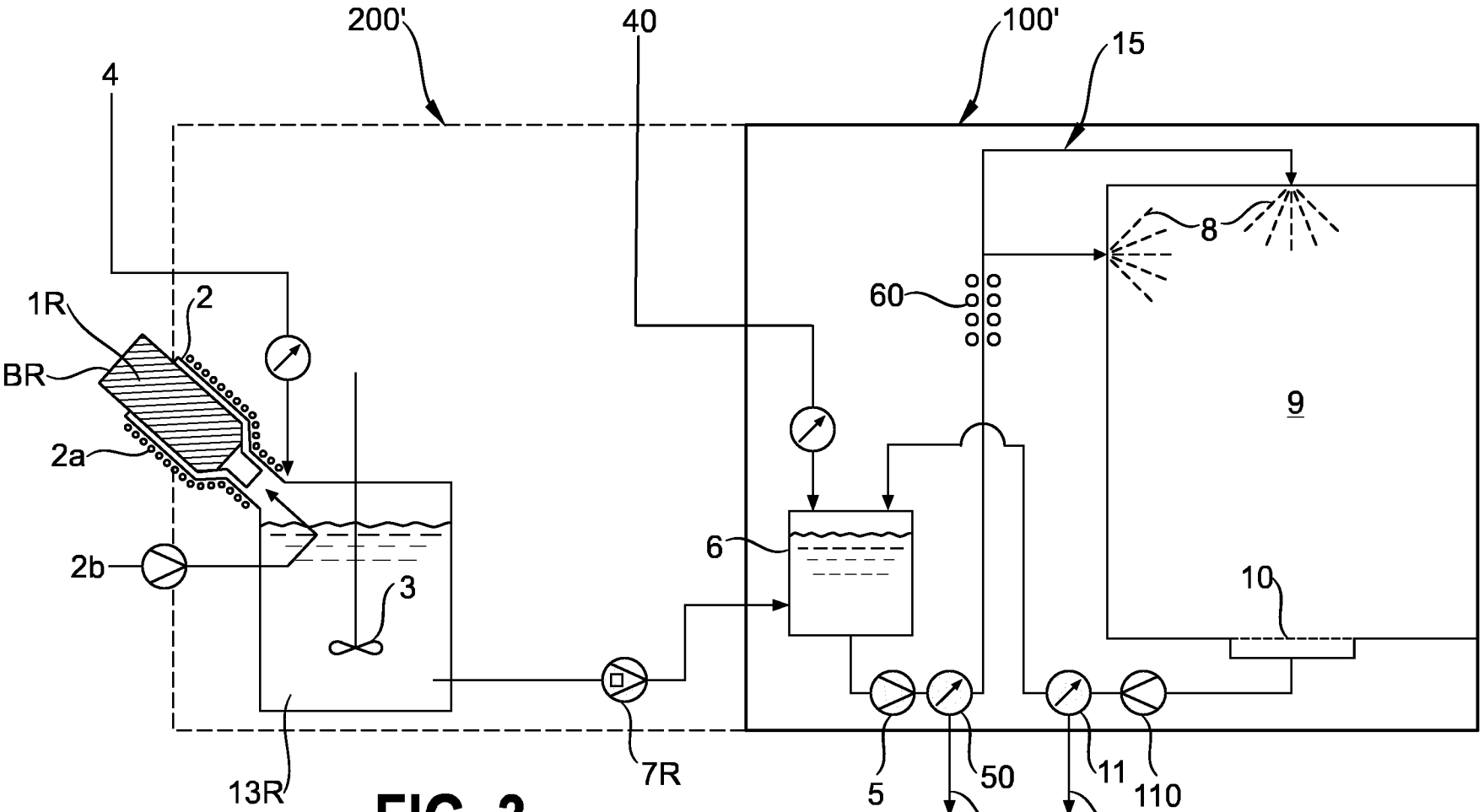
FIG. 3 is a schematic view of a third exemplary embodiment of a commercial cooking device with a cleaning device having an external storage tank.

In another embodiment shown on FIG. 3, a cleaning device 200' located at least partially in an external dosing device secured to the commercial cooking device 100' enables a multiple dosing from a container BR with solid cleaning agent 1R. For example, the bottle here has a capacity of 0.5 to 10 kg of solid cleaning agent 1R, preferably up to 2.5 kg, and especially preferably up to 1 kg.

The external dosing device here comprises a first part of the cleaning device 200', specifically a first supply tank 13R with the connection piece 2 and liquefaction device 2*a*, 2*b*. This external dosing device can be easily docked by way of a line, for example a hose, e.g., to the circulation container 6 in the circulating loop of the cooking device 100'. The complete bottle BR is first emptied into the supply tank 13R, and if necessary diluted with fresh water. The supply tank 13R here has a receiving volume for the cleaning concentrate or cleaning agent for at least two, preferably at least 5, especially preferably at least 10 doses. An individual dose of the cleaning concentrate or cleaning agent for a respective cleaning process can then be transferred from the supply tank 13R by way of a metering pump 7R into a second supply tank 6, here the circulation container 6, and from the latter by way of a pump 5 and inlet openings 8, in particular nozzles 8, into the cooking chamber 9 of the commercial cooking device 100'. The expended cleaning agent is once again drained via the outlet opening 10. All other functions or steps can take place as in the preceding exemplary embodiments.

Figure 4:
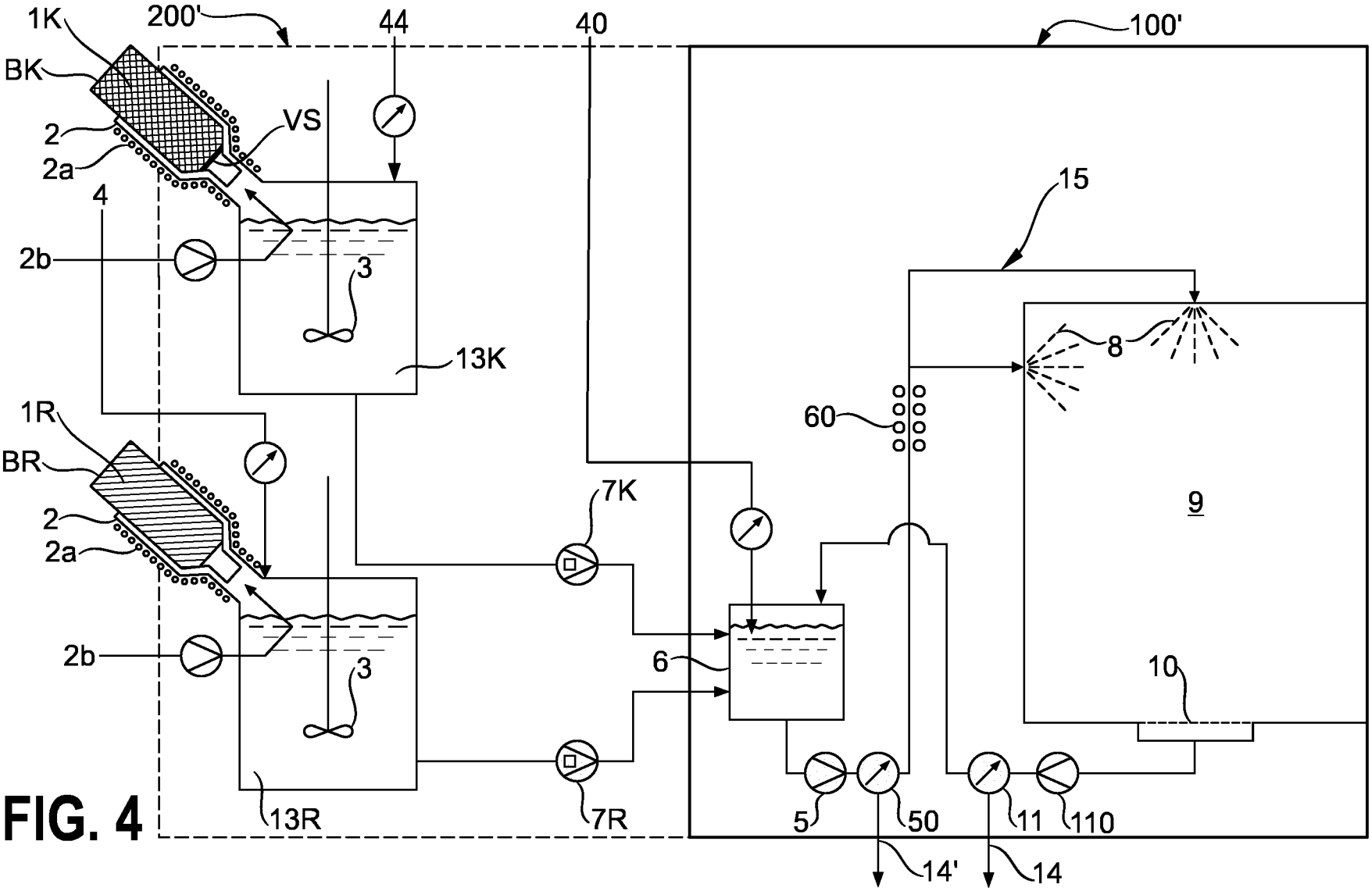
FIG. 4 is a schematic view of a third exemplary embodiment of a commercial cooking device with a cleaning device having an external storage tank.

In the same way, FIG. 4 illustrates an embodiment of a preferred external metering device 200' secured to a commercial cooking device 100' by way of a [word missing], comprising the cleaning device for multiple dosing with a first and a second supply tank 13R, 13K and accompanying connection pieces 2, 22. The second connection piece 22 here provides the receptacle for a container BK that contains a rinsing agent 1K. The first and second supply tanks 13R, 13K here also each comprise a receiving volume for the cleaning agent or rinsing agent for at least two, preferably at least 5, especially preferably at least 10 doses. The second supply tank 13K here has a separate fresh water supply 44. In this case, both supply tanks 13R, 13K of the external dosing device are docked to the circulation container 6 in the circulating loop of the cooking device 100' by lines, for example hoses.

Here as well, an individual dose of the cleaning concentrate or cleaning agent can be transferred from the supply tank 13R into the additional supply tank 6 or the circulation container 6 by way of a dosing pump 7R, if necessary liquefied further with the addition of fresh water via a fresh water supply 40, and transferred into the cooking chamber 9 of the commercial cooking device by means of a pump 5 through inlet openings 8 or nozzles 8. An individual dose of the rinsing agent can analogously be transferred into the supply tank 6 or circulation container 6 by means of a dosing pump 7K, if necessary liquefied further with the addition of fresh water, and transferred into the cooking chamber 9 by means of the pump 5 through inlet openings 8.

Of course, a cleaning agent and rinsing agent cannot be simultaneously dosed; by contrast, the dosing order can be implemented in short sequences.

Finally, let it be noted once again that the devices described in detail above only involve exemplary embodiments, which can be modified by the expert in a wide variety of ways, without departing from the area of the invention. In principle, the solid cleaning agent, in particular the solid gel, could also be combined with known rinsing agent variants, e.g., rinsing agent tabs, which are added via a dispenser drawer, or rinsing agent tabs in a temperature-controlled, water-soluble film, which can be placed in the cooking chamber. For example, the supply tank could be omitted during an individual dosing, and the liquefied cleaning agent and/or rinsing agent could also be guided directly in the line system 15, if necessary in a circuit. Furthermore, use of the indeterminate article "a" or "an" does not mean that the respective features cannot also be present repeatedly. Likewise, the term "unit" does not mean that the latter cannot also consist of several, potentially even spatially separated, subunits.

REFERENCE LIST

1K Rinsing agent
1R Solid cleaning agent
2 Connection unit/connection piece
2*a* Heating device of the liquefaction device
2*b* Rinsing nozzle of the liquefaction device
3 Mixing device/agitator unit
4 Fresh water supply
5 Pump
6 Supply tank/circulation container
7K Dosing pump for rinsing agent
7R Dosing pump for cleaning solution
8 Inlet openings/nozzles
9 Cooking chamber
10 Outlet opening
11 Outlet valve
12 Supply tank/circulation chamber
12R Supply tank/circulation chamber
12K Supply tank/circulation chamber
13R Supply tank
13K Supply tank
14, 14' Outlet line
15 Line system
22 Connection unit/connection piece
22*a* Heating device
22*b* Rinsing nozzle
44 Fresh water supply
50 Outlet valve
55 Pump
60 Trace heater
100, 100' Cooking device
110 Pump
200, 200' Cleaning device
B Container/combination bottle
BR Container/bottle
BK Container/bottle
RK Cleaning agent compartment
KK Rinsing agent compartment
VS Sealing layer

The invention claimed is:

1. A cleaning device for commercial cooking devices, wherein the cleaning device has a connection unit configured to accommodate a container with a solid cleaning agent, a liquefaction device configured to liquefy the solid cleaning agent in the container and further configured to use a solvent if necessary, wherein the cleaning device is further configured for an optional at least one first supply tank.

2. The cleaning device according to claim 1, wherein the liquefaction device has a heating device and/or a rinsing nozzle.

3. The cleaning device according to claim 2, wherein the heating device is designed in such a way as to be operated electrically and/or with warm water and/or condensing steam.

4. The cleaning device according to claim 1, with a number of pumps.

5. The cleaning device according to claim 1, wherein the first supply tank contains a mixing device.

6. The cleaning device according to claim 1, with a line system, for transferring the liquefied solid cleaning agent into a cooking chamber of the cooking device.

7. The cleaning device according to claim 6, wherein a trace heater is arranged on the line system.

8. The cleaning device according to claim 6, wherein the line system comprises a pump.

9. The cleaning device according to claim 1, with an additional connection unit for accommodating an additional container, and optionally an additional liquefaction device allocated to this connection unit.

10. The cleaning device according to claim 9, wherein the additional container contains a rinsing agent.

11. A commercial cooking device comprising a cleaning device according to claim 1.

12. The commercial cooking device of claim 11, wherein the commercial cooking device is a cooking appliance, a grill, an oven, an automatic oven, a steam cooker, a combination steamer, a microwave oven, or a deep fryer.

13. The cleaning device according to claim 1, with an additional supply tank.

14. The cleaning device according to claim 13, wherein the additional supply tank contains a mixing device.

15. The cleaning device according to claim 1, wherein the connection unit is a connection piece.

* * * * *